United States Patent [19]

Uppal

[11] Patent Number: 4,992,034

[45] Date of Patent: Feb. 12, 1991

[54] LOW-SPEED, HIGH-TORQUE GEROTOR MOTOR AND IMPROVED VALVING THEREFOR

[75] Inventor: Sohan L. Uppal, Bloomington, Minn.

[73] Assignee: Eaton Corporation, Cleveland, Ohio

[21] Appl. No.: 342,424

[22] Filed: Apr. 24, 1989

[51] Int. Cl.[5] ..... F01C 1/10; F03C 2/08; F16K 31/44; F16K 39/00

[52] U.S. Cl. ..... 418/61.3; 137/625.23; 251/283

[58] Field of Search ..... 418/61.3; 137/625.22, 137/625.23; 251/283

[56] References Cited

U.S. PATENT DOCUMENTS

| | | | |
|---|---|---|---|
| 2,956,512 | 10/1960 | Brundage | 418/171 |
| 3,270,681 | 9/1966 | Charlson | 418/61.3 |
| 3,270,683 | 9/1966 | McDermott | 418/61.3 |
| 3,309,999 | 3/1967 | Patterson, Jr. | 418/61.3 |
| 3,389,618 | 6/1968 | McDermott | 418/61.3 X |
| 3,425,448 | 2/1969 | Peterson | 418/61.3 X |
| 3,477,379 | 11/1969 | Henkel | 418/54 |
| 3,547,564 | 12/1970 | Charlson | 418/61.3 |
| 4,569,644 | 2/1986 | Swedberg | 418/61.3 |
| 4,818,200 | 4/1989 | White, Jr. | 418/61.3 |

*Primary Examiner*—John J. Vrablik
*Attorney, Agent, or Firm*—L. J. Kasper

[57] ABSTRACT

A rotary fluid pressure device is provided of the type including a gerotor gear set (17) including an orbiting and rotating star (27) providing output torque by means of a main drive shaft (41). The device includes a valve housing section including a relatively thicker outer housing (61) and a relatively thinner inner housing (73) press-fit within the outer housing with an interference fit causing a preload force equal to the equivalent force of a predetermined fluid pressure, to avoid expansion of the spool bore (81). Disposed within the spool bore is a spool valve (55) which is relatively solid and able to withstand the predetermined fluid pressure without collapse of the spool valve. The spool valve defines axial slots (93) and (95) communicating by means of passages (97 and 99) with pressure-balancing recesses (101 and 103), whereby the valve spool is axially pressure balanced. The motor has improved volumetric efficiency, as well as improved mechanical efficiency.

15 Claims, 6 Drawing Sheets

LOW-SPEED, HIGH-TORQUE GEROTOR MOTOR AND IMPROVED VALVING THEREFOR

BACKGROUND OF THE DISCLOSURE

The present invention relates to rotary fluid pressure devices such as low-speed, high-torque gerotor motors, and more particularly, to a novel valving arrangement for such motors, which provides both improved volumetric efficiency and improved mechanical efficiency.

Low-speed, high-torque gerotor motors of the type to which the present invention relates are typically classified, in regard to their method of valving as being either "spool valve" motors or "disc valve" motors. As used herein, the term "spool valve" will refer to a generally cylindrical valve member in which the valving action occurs between the cylindrical outer surface of the spool valve and the adjacent cylindrical surface of the surrounding housing member. In a typical spool valve motor of the type produced commercially by the assignee of the present invention, the spool valve is integral with the motor output shaft (see U.S. Pat. No. 4,592,704, assigned to the assignee of the present invention).

In the typical spool valve motor, side loads (loads exerted radially on the output shaft) are transmitted to the spool valve, requiring that the spool valve include one or more bearing or journal surfaces able to engage the cylindrical spool bore defined by the housing. Such bearing surfaces add to the overall size, complexity, and machining cost of the spool valve. Partly as a result of the presence of such bearing surfaces, the spool valve motor is subject to thermal shocks, i.e., warm hydraulic fluid entering a cold motor can cause expansion of the spool valve, and thermal seizure of the spool within the bore. Also, as will be understood by those skilled in the art, it is obviously not possible with a spool valve motor to offer the customer a "bearingless" version in which the dogbone shaft transmits torque directly from the gerotor gear set into the customer's internally splined device (such as a wheel hub).

The correct valve timing of a spool valve motor is dependent upon the correct rotational relationship between the spool valve and the gerotor ring (which defines the volume chambers). The spool valve is driven by the dogbone shaft, which transmits torque from the gerotor to the output shaft. Therefore, any wear of the torque transmitting spline connection (either between the star and the dogbone or between the dogbone and the output shaft) changes the timing of the spool valve.

One final disadvantage of the typical spool valve motor, as it relates to the present invention, is the tendency for the volumetric efficiency of a spool valve motor to decrease drastically with increasing pressure. It has been determined that the spool valve in a typical spool valve motor may undergo a diametral "collapse" or reduction in overall diameter, of approximately 0.001 inches when the motor is subjected to an operating pressure differential of approximately 2,000 psi. Any such collapse of the spool valve results in an increased radial clearance between the spool valve outer surface and the spool bore, permitting cross-port leakage between adjacent high-pressure and low-pressure regions, and substantially reduced volumetric efficiency.

One of the primary advantages of a spool valve motor is that an almost negligible amount of the motor output torque is used merely to drive the spool valve. Thus, the typical spool valve motor has a relatively high mechanical efficiency.

Accordingly, it is an object of the present invention to provide an improved low-speed, high-torque gerotor motor which retains the high mechanical efficiency characteristic of the typical spool valve motor, but overcomes the various disadvantages of spool valve motors.

It is a more specific object of the present invention to provide an improved spool valve motor which substantially overcomes the problem of pressurized collapse of the spool valve, and thus has a significantly better volumetric efficiency than prior art spool valve motors.

A "disc valve" motor as used herein shall mean a motor in which the valve member is generally disc-shaped, and the valving action occurs between a transverse surface of the disc valve (perpendicular to the axis of rotation) and an adjacent, stationary transverse surface (see U.S. Pat. No. 3,572,983, assigned to the assignee of the present invention, and incorporated herein by reference).

The typical disc valve motor produced by the assignee of the present invention has been relatively more expensive to produce than a similar spool valve motor. One reason for the greater expense is that a disc valve motor requires some sort of axial pressure-balancing mechanism which, in the motors produced commercially by the assignee of the present invention, actually provides a pressure "overbalance", i.e., a net force biasing the disc valve against the stationary valve surface. If the disc valve were truly axially balanced, "lift-off" of the valve member (i.e., axial separation of the disc valve from the stationary valve) would occur readily, resulting in substantial cross-port leakage and stalling of the motor. However, lift-off of the disc valve is largely prevented by the pressure overbalance of the balancing mechanism.

One major disadvantage of the typical disc valve motor is a result of the necessary pressure overbalance applied to the disc valve, as described above. The overbalance force, biasing the disc valve into sliding, sealing engagement with the adjacent stationary valve surface, results in lower mechanical efficiency in disc valve motors because the torque required to drive the disc valve detracts from the net torque output of the motor.

One of the primary advantages of disc valve motors is that, because of the sealing engagement between the disc valve and the stationary valve surface, the volumetric efficiency of the motor decreases only very slightly with increasing pressure differential across the motor.

Accordingly, it is an object of the present invention to provide an improved low-speed, high-torque gerotor motor which maintains the good volumetric efficiency characteristic of the typical disc valve motor, while overcoming the disadvantages of disc valve motors.

The above and other objects of the present invention are accomplished by the provision of a rotary fluid pressure device of the type including housing means defining fluid inlet and fluid outlet means. A fluid energy-translating displacement means is associated with the housing and includes one member having rotational movement relative to the housing and one member having orbital movement relative to the housing, to define expanding and contracting fluid volume chambers in response to the rotational and orbital movements. A valve means cooperates with the housing to provide fluid communication between the fluid inlet and the expanding volume chambers and between the contracting volume chambers and the fluid outlet. The device includes an input-output shaft and means for transmitting torque between the member of the displacement means having rotational movement and the input-output shaft. The valve means comprises a generally cylindrical spool valve member, defining a pair of end surfaces, and defining valving passages on its outer cylindrical surface. The spool valve is rotated at the speed of rotation of the member of the displacement means having rotational movement. The housing means comprises a valve housing section defining a spool bore and surrounding the spool valve member, and further defining a plurality of meter passages, each being in fluid communication with one of the fluid volume chambers.

The improved rotary fluid pressure device is characterized by the spool valve member and the valve housing section being disposed on the side of the displacement means which is opposite the input-output shaft. The spool valve member is relatively solid, whereby the spool valve member is able to withstand the force of a predetermined fluid pressure, without substantial collapse of the spool valve member.

The improved rotary fluid pressure device is further characterized by the valve housing section including a relatively thicker outer housing portion and a relatively thinner inner housing portion defining the spool bore. The inner housing portion is press-fit within the outer housing portion with an interference fit sufficient to preload the inner housing portion with a preload force at least equal to the equivalent force of the predetermined fluid pressure, whereby the inner housing portion will be able to withstand the predetermined fluid pressure, without substantial expansion of the spool bore.

DESCRIPTION OF THE PREFERRED EMBODIMENT

Figure 1:
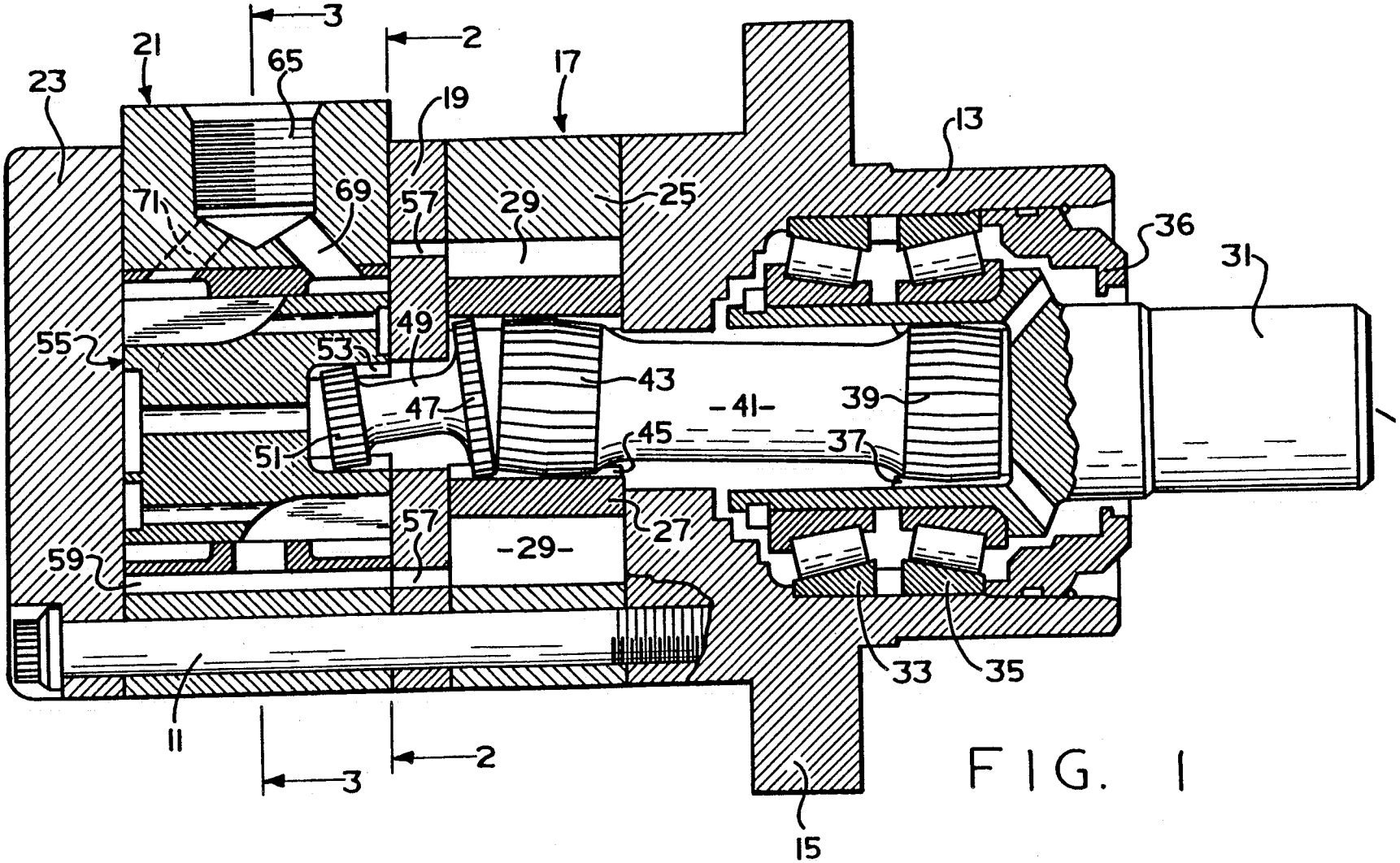
FIG. 1 is an axial cross-section of a low-speed, high-torque gerotor motor made in accordance with the present invention.

Referring now to the drawings, which are not intended to limit the invention, FIG. 1 illustrates a low-speed, high-torque gerotor motor made in accordance with the present invention. The hydraulic motor shown in FIG. 1 comprises a plurality of sections secured together, such as by a plurality of bolts 11. The motor includes a shaft support casing 13, including a mounting flange 15, a gerotor displacement mechanism 17, a port plate 19, a valve housing section 21, and an endcap 23.

The gerotor displacement mechanism 17 is well known in the art, is shown and described in U.S. Pat. No. 4,533,302, assigned to the assignee of the present invention, and will be described only briefly herein. More specifically, the gerotor displacement mechanism 17 comprises an internally-toothed ring member 25, and an externally-toothed star member 27, eccentrically disposed within the ring member 25, and having one less tooth than the ring member 25. The star member 27, in the subject embodiment, orbits and rotates relative to the ring member 25, and this orbital and rotational movement defines a plurality of expanding and contracting fluid volume chambers 29. It should be clearly understood by those skilled in the art that the present invention is not limited to a device in which the ring member is fixed and the star member orbits and rotates, but instead, either the ring or the star can have either the orbital or rotational movement. Furthermore, the present invention is not necessarily limited to a gerotor as the fluid displacement mechanism.

Referring still to FIG. 1, the motor includes an output shaft 31 positioned within the shaft support casing 13, and rotatably supported therein by suitable bearing sets 33 and 35. Disposed adjacent the forward end of the bearing set 35 is a bearing retainer and snap ring assembly, generally designated 36. The shaft 31 includes a set of internal, straight splines 37, and in engagement therewith is a set of external, crowned splines 39, formed on the forward end of a main drive shaft 41. Disposed at the rearward end of the main drive shaft 41 is another set of external, crowned splines 43, in engagement with a set of internal, straight splines 45, formed on the inside diameter of the star 27. In the subject embodiment, the ring 25 includes seven internal teeth, and the star 27 includes six external teeth. Therefore, six orbits of the star 27 result in one complete rotation thereof, and one complete rotation of the main drive shaft 41 and the output shaft 31. It should be understood by those skilled in the art that the term "input-output shaft means" as used hereinafter in the claims may refer to either the output shaft 31 or the main drive shaft 41.

Also in engagement with the internal splines 45 of the star 27 is a set of external splines 47 formed about one end of a valve drive shaft 49 which has, at its opposite end, another set of external splines 51 in engagement with a set of internal splines 53 formed about the inner periphery of a valve spool, generally designated 55. The valve spool 55 is rotatably disposed within the valve housing section 21, both of which will be described in greater detail subsequently.

Referring still to FIG. 1, the port plate 19 defines a plurality of fluid passages 57 (only two of which are shown in FIG. 1), each of which is disposed to be in continuous fluid communication with the adjacent volume chamber 29. In the subject embodiment, there are seven of the fluid passages 57, because the ring member 25 has seven internal teeth, and therefore defines seven of the fluid volume chambers 29.

Figure 2:
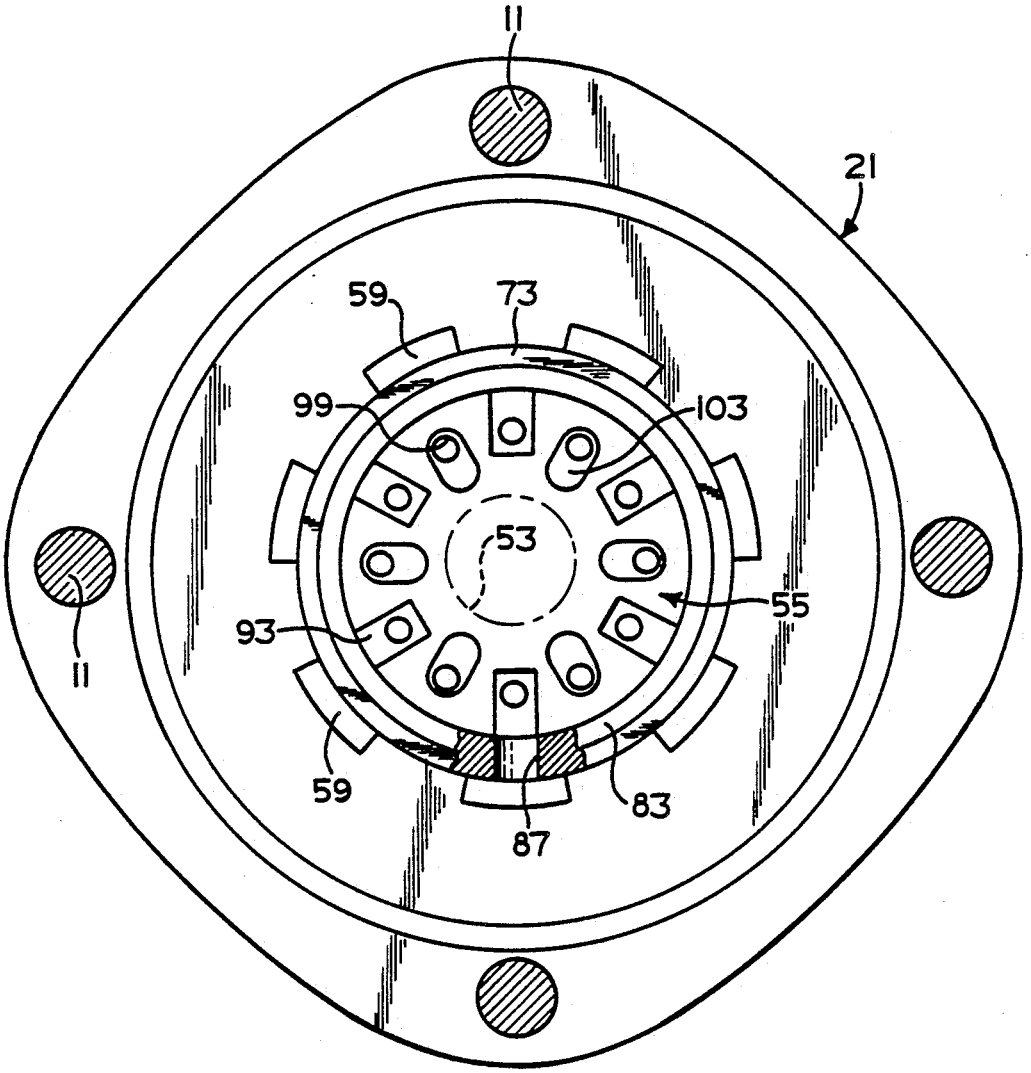
FIG. 2 is a transverse cross-section taken on line 2—2 of FIG. 1, but on a larger scale.
Figure 3:
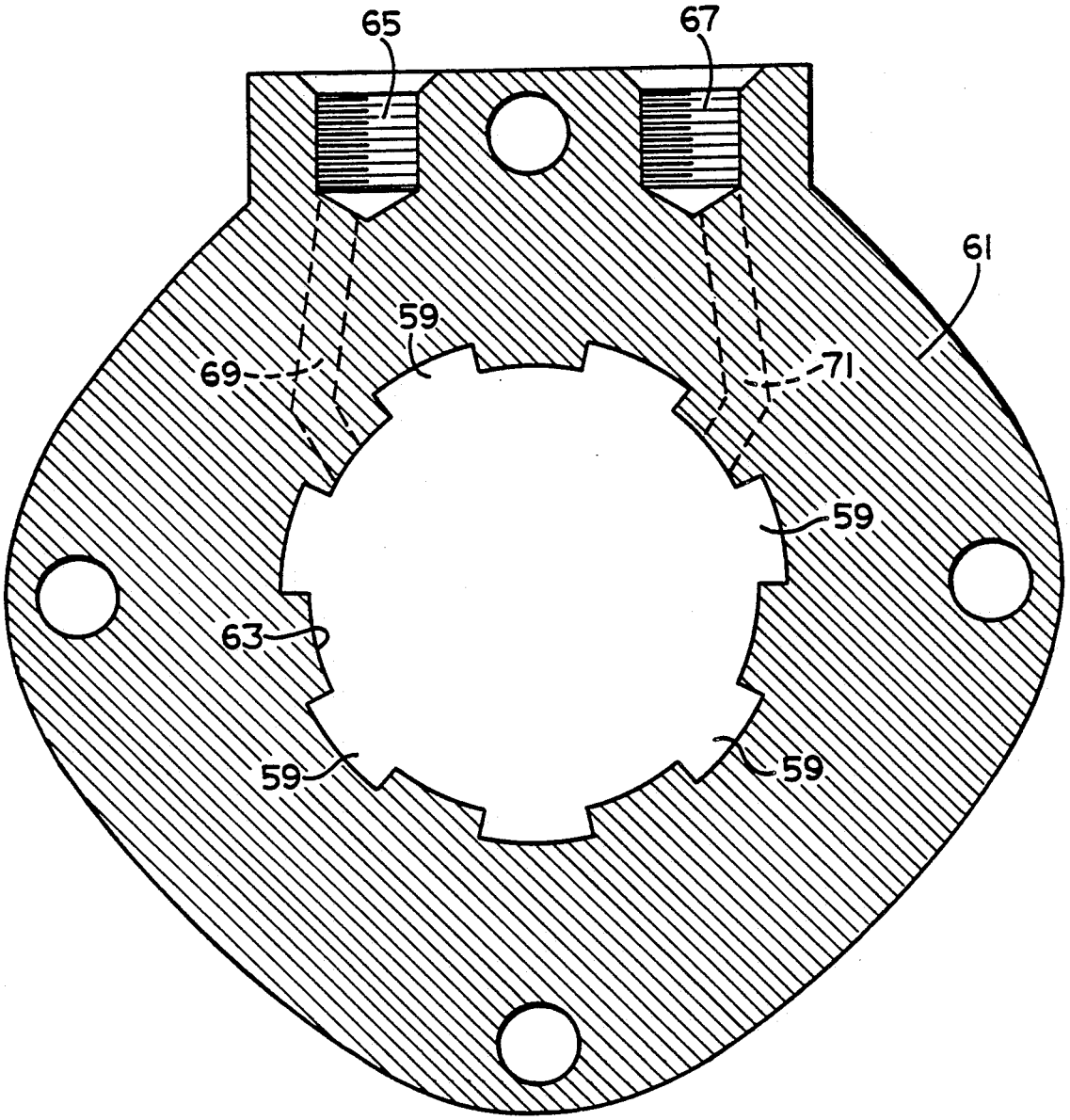
FIG. 3 is a transverse cross-section, similar to FIG. 2, but taken on line 3—3 of FIG. 1, illustrating only the outer housing portion of the valve housing section, made in accordance with the present invention.

Referring now to FIGS. 2 and 3, and comparing them to FIG. 1, it may be seen that FIGS. 2 and 3 actually represent an alternative embodiment which differs from the embodiment of FIG. 1 only in that the valve housing section 21 is larger, radially. In FIG. 2, there is illustrated a transverse, plan view of the valve housing section 21 and valve spool 55. The valve housing section 21 defines a plurality of fluid passages 59 (sometimes also referred to as meter passages) which, in the subject embodiment, extend the full axial length of the valve housing 21 (see FIG. 1). Each of the meter passages 59 is in open fluid communication with one of the fluid passages 57 and thus, there are seven of the meter passages 59 shown in FIG. 2.

The valve housing section, generally designated 21, includes an outer housing portion 61 defining a generally cylindrical inner surface 63, and further defining a fluid inlet port 65 and a fluid outlet port 67. The outer housing portion 61 also defines a fluid passage 69 communicating between the inlet port 65 and the inner surface 63, and a fluid passage 71 communicating between the fluid outlet port and the inner surface 63.

Figure 5:
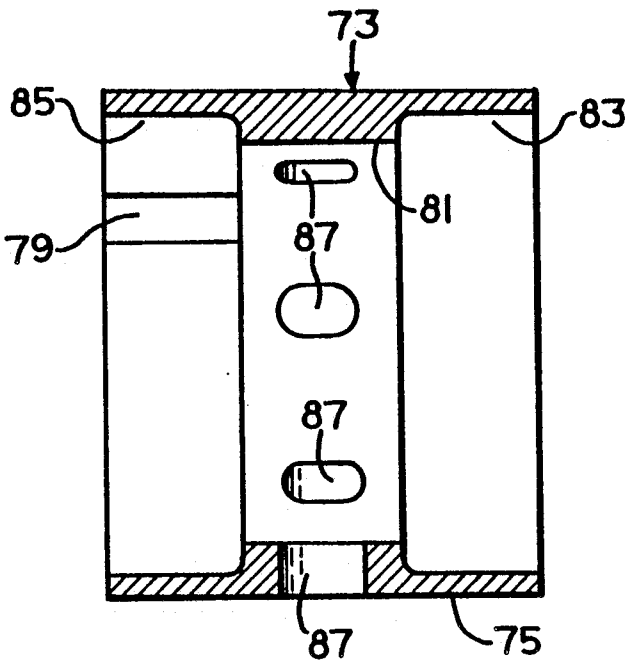
FIG. 5 is an axial cross-section taken through the inner housing portion of FIG. 4, and on the same scale as FIG. 4.
Figure 4:
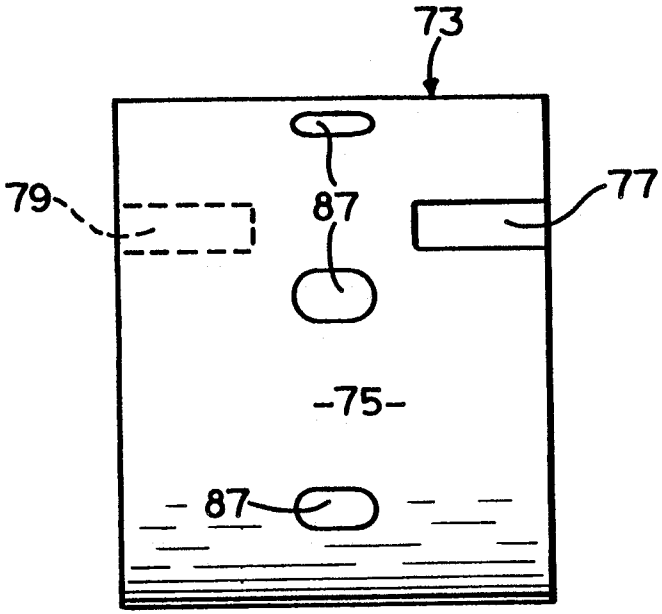
FIG. 4 is an axial plan view of the inner housing portion of the valve housing section, made in accordance with the present invention, and on the same scale as FIG. 2.

Referring now to FIGS. 4 and 5 (note that FIGS. 3, 4 and 5 are on the same scale), the valve housing section 21 also includes an inner housing portion 73 which, as may be seen in FIG. 2, is generally cylindrical, and includes a generally cylindrical outer surface 75. It should be noted that the inner housing portion 73 is oriented in exactly the same position in FIGS. 1, 4, and 5, the only difference between FIGS. 4 and 5 being that FIG. 5 is a cross-section, rather than an external plan view. The inner housing portion 73 defines a fluid port 77 (shown only in FIG. 4) which is in open fluid communication with the inlet port 65 by means of the fluid passage 69. Similarly, the inner housing portion 73 defines a fluid port 79 (shown only in dotted form in FIG. 4, but in solid form in FIG. 5) which is in open communication with the outlet port 67 by means of the fluid passage 71.

Referring now primarily to FIG. 5, the inner housing portion 73 defines a generally cylindrical inner surface 81, which comprises a spool bore, and provides the sole rotational support for the valve spool 55. The inner housing portion 73 further defines a forward internal annular groove 83, in open communication with the fluid port 77, and a rearward internal annular groove 85, in open communication with the fluid port 79.

Referring again to both FIGS. 4 and 5, in conjunction with FIG. 2, the inner housing portion 73 defines a plurality of radial ports 87, each of the radial ports 87 providing fluid communication between the spool bore 81 and an adjacent one of the meter passages 59 (see FIG. 2). Therefore, in the subject embodiment, the inner housing portion 73 defines seven of the radial ports 87.

Subsequently, in describing the present invention, the outer housing portion 61 is referred to as being "relatively thicker" and the inner housing portion 73 is referred to as being "relatively thinner", the terms "thicker" and "thinner" referring to the radial dimension of the portions 61 and 73. As will be understood by those skilled in the art from the subsequent description, the purpose of the outer housing portion 61 being relatively thicker is for it to be subjected to the rated fluid pressure of the motor, without substantial deflection or expansion, radially. Similarly, the purpose of the inner housing portion 73 being relatively thinner is for it to be able to be press-fit into the outer housing portion 61, with the outer surface 75 being in tight sealing engagement with the inner surface 63. As may best be seen in FIG. 2, one result of the press-fit of the inner housing portion 73 into the outer housing portion 61 is that the portions 73 and 61 cooperate to define the meter passages 59, thus eliminating the need for machining of the meter passages 59.

It is one important aspect of the present invention that the inner housing 73 not be merely press-fit into the outer housing 61 in such a way as to maintain firm engagement therebetween. Instead, it is an important aspect of the invention that the press-fit process be related to the rated pressure of the motor. For example, if the motor is rated for continuous operation at 3,000 psi., merely by way of example, the degree of interference between the inner housing 73 and outer housing 61 should be selected such that after the press-fit, the resulting radial preload on the inner housing portion 73 is approximately equivalent to, and therefore balances, the radial force exerted by pressurized fluid at the rated, continuous pressure of 3,000 psi. As a result of this matching of the press-fit preload, and some predetermined fluid pressure level, there will be no substantial radial expansion of the spool bore 81 during operation of the motor at the predetermined pressure.

It should be apparent to those skilled in the art that the press-fit preload can be matched to a pressure level above the continuous, rated pressure, or can be matched to a pressure somewhat lower, at the option of the motor designer. By way of further example, it was found during the development of the present invention that providing the inner housing 73 with an interference of approximately 0.005 to 0.006 inches, relative to the outer housing 61 resulted in a preload equivalent to operation of the motor at 4,000 psi., and therefore, operation of the motor at 4,000 psi. resulted in no substantial expansion of the inner housing portion 73.

It should be understood by those skilled in the art that the use of terms such as "press-fit" or "interference" herein are not intended to limit the invention to any particular method of assembly of the inner and outer housing portions, and the use of the above and other similar terms hereinafter and in the claims will be understood to include any other type of process capable of achieving the same results. As one example only, the assembly of the inner and outer housing portions could be accomplished by means of a temperature shrink-fit process.

Figure 7:
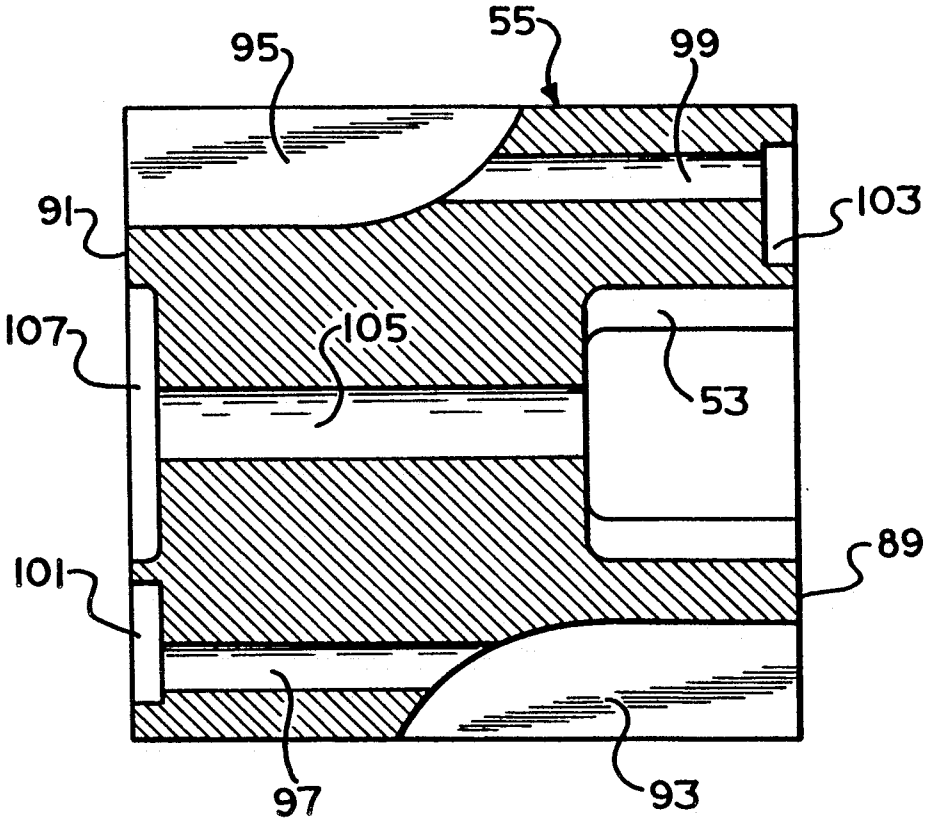
FIG. 7 is an axial cross-section taken on line 7—7 of FIG. 6, and on the same scale, with both FIGS. 6 and 7 being on a larger scale than any of the preceding figures.
Figure 6:
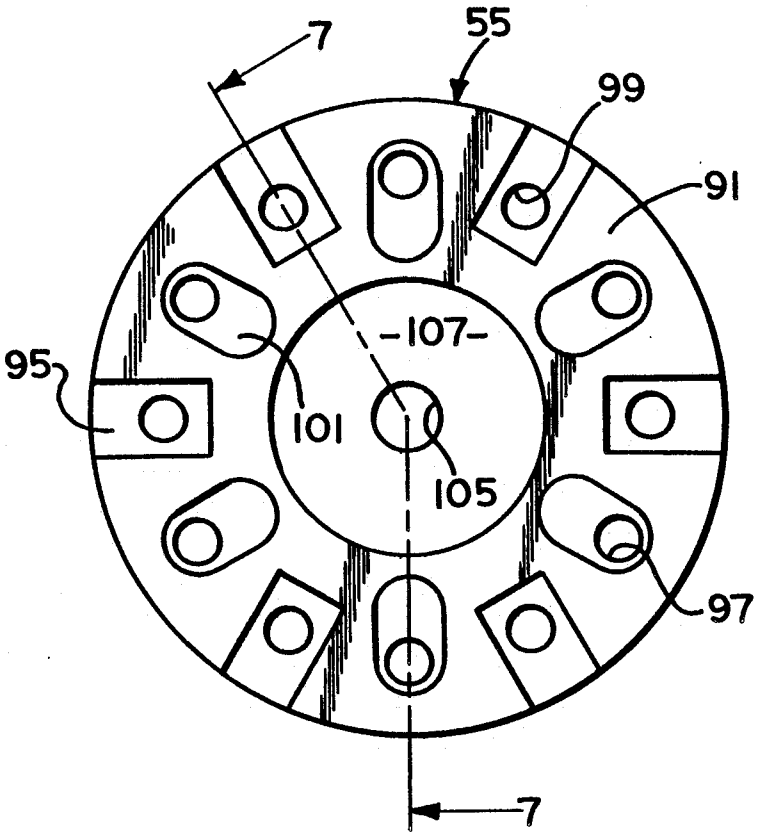
FIG. 6 is a plan view, taken on a transverse plane, of the end of the spool valve of the present invention, viewed from the left in FIG. 1.

Referring now primarily to FIGS. 6 and 7, the valve spool 55 will be described in greater detail. As may best be seen in FIG. 7, it is one important aspect of the present invention that the valve spool 55 is relatively solid, i.e., having sufficient radial thickness that operation of the motor at some predetermined pressure level will not cause substantial collapse of the spool. It will be understood that, as used herein, the term "collapse" refers to a decrease in the outer diameter of the valve spool 55.

Preferably, the "predetermined pressure" referred to above which the valve spool 55 is able to withstand, without collapse, will be selected to be the same as the predetermined pressure which is matched to the preload on the inner housing portion 73. In other words, both the housing and the valve spool are designed to operate at some predetermined pressure, at which the spool bore will not expand, and the valve spool will not collapse, thus preventing a rapid drop off of the volumetric efficiency at the predetermined pressure.

The valve spool 55 defines a forward end surface 89, disposed adjacent the port plate 19, and a rearward end surface 91, disposed adjacent the endcap 23. The valve spool 55 further defines a plurality of forward axial slots 93, and a plurality of rearward axial slots 95. The axial slots 93 are open at the end surface 89 (see FIG. 2), and the axial slots 95 are open at the end surface 91, as may be seen in FIG. 6. The axial extent of the axial slots 93 and 95 overlap each other, such that each of the slots 93 or 95 is able to communicate fully with each of the radial ports 87, to provide low-speed, commutating valving communication, of the type which is well known to those skilled in the art. The axial slots 93 and axial slots 95 are arranged in an alternating, interdigitated pattern about the outer periphery of the valve spool 55. As is also well known to those skilled in the art, the valve spool 55 includes six of the axial slots 93, and six of the axial slots 95, because there are seven of the volume chambers 29 and seven each of the fluid passages 57, meter passages 59, and radial ports 87.

In communication with each of the axial slots 93 is an axial passage 97, and in communication with each of the axial slots 95 is an axial passage 99. Each of the axial passages 97 opens into a pressure-balancing recess 101, formed in the end surface 91. Similarly, each of the axial passages 99 opens into a pressure-balancing recess 103 (see also FIG. 2), formed in the end surface 89. It is an important aspect of the present invention that the valve spool 55 be axially pressure balanced (rather than pressure overbalanced as are disc valves), in order that the amount of torque required to turn the valve spool 55 is so small that it does not represent any substantial decrease in the mechanical efficiency of the motor. As used herein, the term "axially pressure balanced" means that, regardless of the pressure differential across the motor, the fluid pressure forces acting on the valve spool to bias it forwardly are approximately equal to, and balanced by, the fluid pressure forces acting on the valve spool to bias it rearwardly.

In order to accomplish such axial pressure-balancing, it is preferred, although not an essential feature of the invention, that the cross-sectional area of each of the pressure-balancing recesses 101 is nearly equal to the cross-sectional area of its respective axial slot 93. Similarly, the cross-sectional area of each of the pressure-balancing recesses 103 should be nearly equal to the cross-sectional area of each of its respective axial slots 95. The reference to cross-sectional area of the recesses 101 and 103 and slots 93 and 95 refers to the area as seen in FIGS. 2 and 6, i.e., the area measured on a plane transverse to the axis of rotation.

The valve spool 55 defines a central axial passage 105 which interconnects the forward recess, within the internal splines 53, with a central pressure-balancing recess 107. For the same reason explained previously, the cross-sectional area of the recess 107 should be substantially equal to the cross-sectional area defined by the internal splines 53. As noted previously, the valve spool 55 is referred to as being "relative solid", despite the presence of the axial passage 105, based upon the ability of the valve spool 55 to withstand the predetermined pressure without collapse of the spool.

As was discussed previously, prior art spool valve motors required bearing areas on the ends of the valve spool, partially to provide sufficient side load capability. Such prior art spool valves defined annular grooves, disposed axially between the end bearing surfaces and the axial slots (similar to slots 93 and 95 in FIG. 7). Therefore, one disadvantage of the prior art valve spool was that it could not readily be fabricated as a powdered metal or sintered metal part. One important aspect of the present invention is that the valve spool 55 defines no annular grooves on its outer cylindrical surface, and has no cylindrical bearing surfaces on its ends, and therefore, can be easily fabricated as a powdered metal or sintered metal part. In addition, the configuration of the valve spool 55 facilitates centerless grinding as the only machining step on the outer cylindrical surface. The ability to centerless grind the outer surface, coupled with the fact that the valve spool 55 is relatively short, has made it possible to have a reduced clearance between the outer surface of the valve spool 55 and the adjacent spool bore 81, which further improves the volumetric efficiency of the motor.

It should be apparent to one skilled in the art from a review of FIG. 1 that the valve spool 55 must have a small amount of axial end clearance, to permit it to rotate freely when driven by the valve drive shaft 49. The required end clearance can be provided in either of two ways. One way is to grind the axial end faces of the valve spool 55 and valve housing section 21 so that both have the same overall axial length, and then shim the housing. Another way is to grind the valve spool 55 somewhat shorter than the valve housing section 21. It is believed that the appropriate end clearance of the valve spool 55 can be readily determined by one skilled in the art, without undue experimentation, such that the end clearance is enough to avoid an increase in the torque required to turn the valve spool, without being so much as to permit leakage which would reduce volumetric efficiency.

Another advantage of the design of the invention relates to valve timing. As noted previously, in most spool valve motors, the spool valve is driven by the dogbone drive shaft, which is also the main torque transmitting drive shaft of the motor. Therefore, any wear of the splines on the main drive shaft, or any "torque windup" of the main drive shaft, will change the valve timing. In the present invention, the valve spool 55 is driven by the separate valve drive shaft 49, which is the same manner of drive normally used in disc valve motors. However, because the valve spool 55 is capable of being axially balanced, rather than being overbalanced as is the typical disc valve, the amount of torque required to drive the valve spool is so little that it represents a negligible loss of mechanical efficiency.

Those skilled in the art, and familiar with both spool valve and disc valve motors, will recognize that an additional advantage of the present invention is related to one of the inherent advantages of a spool valve, i.e., that the amount of sealing surface between adjacent ports (or slots 93 and 95) is greater in a spool valve than in a disc valve. Related to this advantage is the fact that a disc valve configuration cannot be used for the relatively smaller motor sizes, because the likelihood of cross-port leakage increases as the disc valve is made smaller. On the other hand, the improved spool valve design of the invention is especially suited for use in relatively smaller motors, and can be used in a much smaller and less expensive motor, without substantial concern regarding cross-port leakage, than can a disc valve design.

ALTERNATIVE EMBODIMENT

Figure 8:
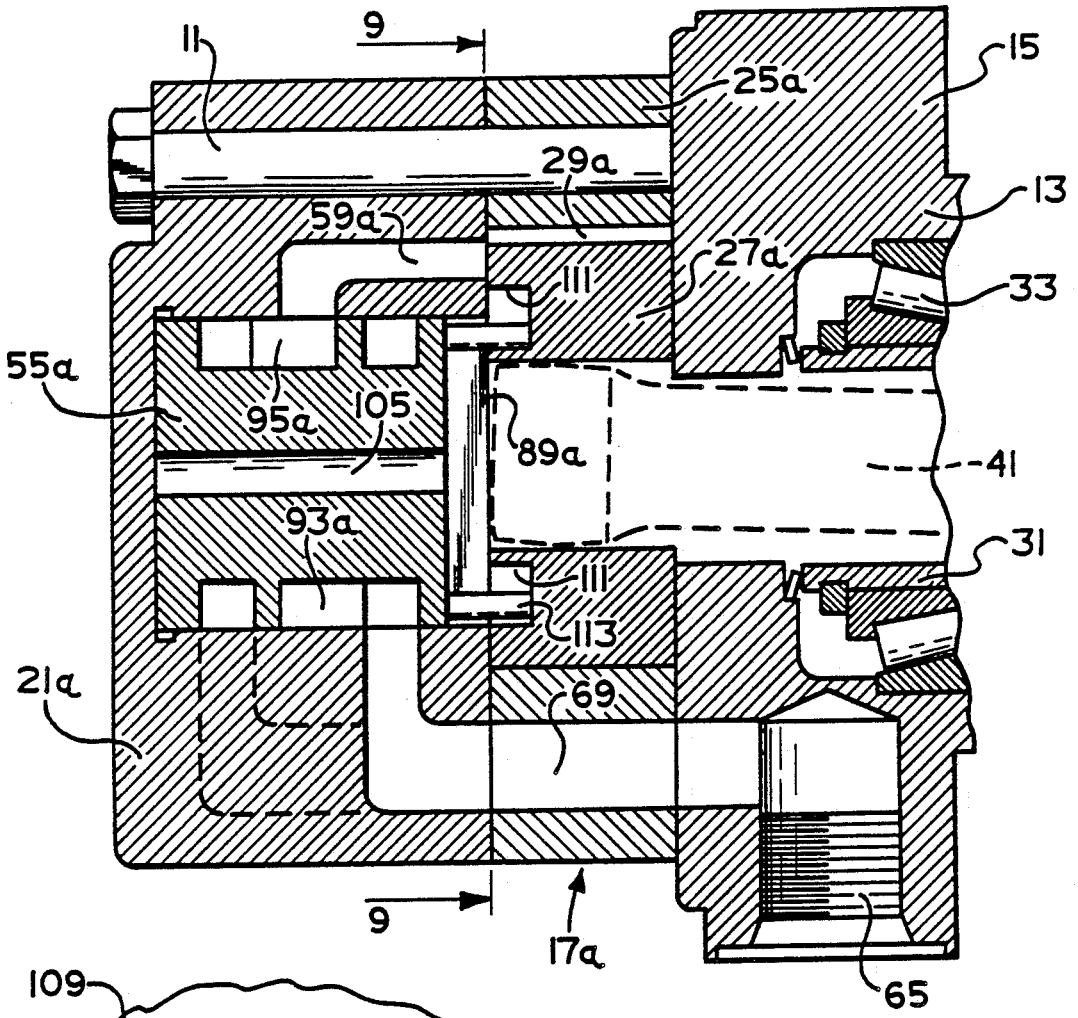
FIG. 8 is a fragmentary, axial cross-section, similar to FIG. 1, illustrating an alternative embodiment of the present invention.
Figure 9:
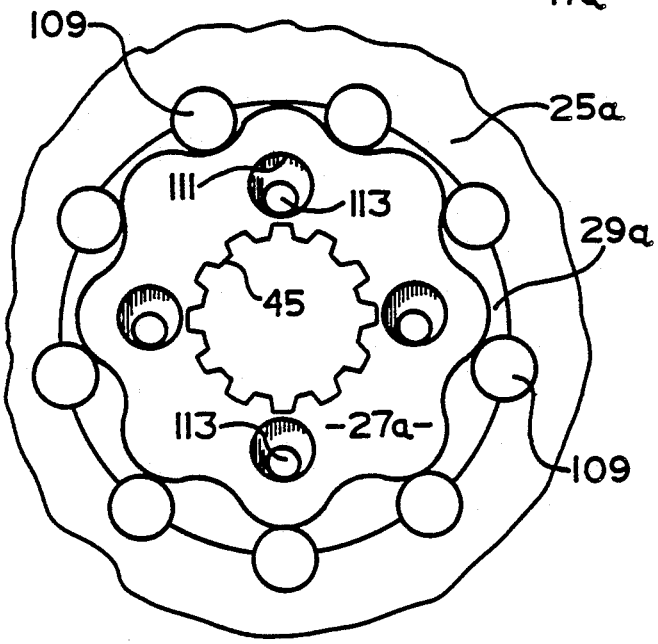
FIG. 9 is a fragmentary, transverse cross-section taken on line 9—9 of FIG. 8, and on the same scale.
Figure 10:
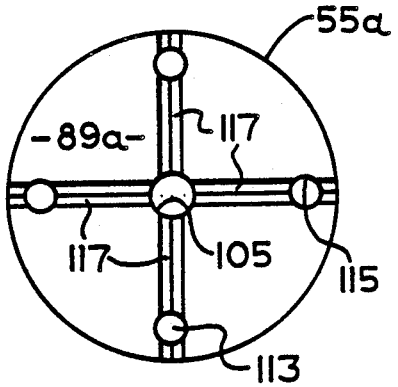
FIG. 10 is a plan view, taken on a transverse plane, of the end of the spool valve of the alternative embodiment of FIG. 8, viewed from the right in FIG. 8.

Referring now to FIGS. 8, 9 and 10, there is illustrated an alternative embodiment of the present invention in which like elements bear the same reference numeral as in the embodiment of FIGS. 1–7, modified elements bear the same reference numeral accompanied by the designation "a", and new elements bear reference numerals beginning with "109".

In the embodiment of FIG. 8, the port plate 19 has been removed, such that the gerotor gear set 17*a* is disposed immediately adjacent the valve housing section 21*a*, and each of the meter passages 59*a* is in direct communication with each of the volume chambers 29*a*, the endcap 23 has also been removed, with the valve housing 21*a* being generally cup-shaped. The removal of the port plate 19 and the endcap 23 has the advantage of decreasing the overall length of the motor but, as will be understood by those skilled in the art, necessitates the use of something other than the valve drive shaft 49 to transmit the rotary motion of the star 27 to the valve spool 55.

Therefore, in the embodiment of FIGS. 8, 9 and 10, a modified internally-toothed ring member 25*a* includes 9 internal teeth, comprising roller members 109, and disposed within the ring 25*a* is a modified star 27*a*, having 8 external teeth or lobes. The star 27*a*, toward its left end in FIG. 8, defines 4 semi-cylindrical, oversized openings 111, which may either be disposed just radially outwardly of the internal splines 45 as shown in FIG. 9, or may actually interrupt the spaces between adjacent splines. Disposed within each opening 111 is a generally cylindrical drive pin member 113. Preferably, the length of the opening 111, defined by the star 27*a*, is just sufficient to receive approximately half of the total length of each of the pins 113.

Referring now primarily to FIGS. 8 and 10, the valve spool 55*a* is modified somewhat from that shown in the FIG. 1 embodiment. As may be seen in FIG. 9, there are 9 volume chambers 29*a*, and therefore, there are 9 of the meter passages 59*a*. As a result, the valve spool 55*a* has 8 axial slots 93*a* and 8 axial slots 95*a*, for reasons which are readily apparent to those skilled in the art. It should be noted that in the embodiment of the valve spool 55*a* shown in FIG. 8, the axial slots 93*a* and 95*a* do not extend axially to the end surfaces of the valve spool 55*a*, but instead, are more like the axial slots in conventional prior art spool valve motors. As is well known to those skilled in the art, the axial slots 93*a* and 95*a* inherently provide axial pressure-balancing of the valve spool 55, and therefore, the alternative embodiment of FIG. 8 does not require the axial passages 97 and 99 and pressure-balancing recesses 101 and 103 of the FIG. 1 embodiment.

Referring still to FIGS. 8 and 10, the valve spool 55*a* includes a forward end surface 89*a* which defines 4 counterbores 115, each of which receives the rearward half of one of the drive pins 113, with the size of each of the counterbores preferably being selected such that each of the drive pins 113 is press-fit therein. The general concept of transmitting rotational motion from one member (star 27*a*) which also has orbital motion, to another member (valve spool 55*a*) by means of pins disposed in oversized holes is generally well known to those skilled in the art. It is also generally well known that the diameter of each of the counterbores 111 must be equal to the diameter of the drive pin 113 plus twice the eccentricity of the gerotor set 17*a*. Therefore, it is preferred in the alternative embodiment to utilize a gerotor gear set such as the 8:9 set shown in FIG. 9, which inherently has a relatively smaller eccentricity than the 6:7 gear set of the FIG. 1 embodiment, thus avoiding the need for the counterbores 115 to be excessively large.

Referring still to FIG. 10, the forward end surface 89*a* of the valve spool 55*a* defines 4 radially oriented grooves 117 which extend from the axial passage 105 to the outer surface of the valve spool 55, each one intersecting its respective counterbore 115. The purpose of the grooves 117 is to provide lubrication to the pins 113, the source of the lubricant being either leakage fluid which flows radially outward from the axial passage 105, or leakage fluid from the region between the valve spool 55*a* and the valve housing 21*a* which flows radially inward.

The motor of the present invention provides certain performance improvements relating to efficiency. Because the design utilizes a spool valve, the motor has a higher mechanical efficiency than typical disc valve designs, for reasons explained in the background of this specification. At the same time, the press-fit of the inner housing portion 73 and the relatively solid valve spool 55 provides substantially greater volumetric efficiency than typical spool valve motors. As is well known to those skilled in the art, overall efficiency is, mathematically, the product of mechanical efficiency and volumetric efficiency, such that the motor of the present invention has a substantially higher overall efficiency than either prior art spool valve or disc valve designs.

The motor of the present invention provides certain additional advantages, other than the efficiency described above. Among such advantages are the ability to provide an improved spool valve motor (and thus a motor having a higher mechanical efficiency), in which it is possible to offer the customer a bearingless option. In order to convert the motor shown in FIG. 1 to a bearingless option, all that is required is to remove the shaft support casing 13, the output shaft 31, and the bearing sets 33 and 35, and replace the removed part with a front endcap having a central opening through which the main drive shaft 41 extends.

Another advantage of the spool valve motor of the present invention is the ability to have access, through the endcap 23, to a member which is rotating at the output speed of the motor (i.e., the valve spool 55). By way of example only, the access described above makes it possible to mount, in the endcap 23, a motor speed sensor, the output of which may be used as an input to some electrical/electronic closed-loop control circuit. As will be understood by those skilled in the art, with the typical prior art spool valve motor, there is no part of the motor which can be accessed through the endcap which has purely rotary motion and can therefore be utilized as the basis for a speed pick-up signal. As will also be understood by those skilled in the art, in the typical prior art disc valve motor, it is possible to have access through the endcap to the disc valve, which has purely rotary motion. However, it would not be feasible to mount a speed sensor in the endcap because of the presence of the pressure-balancing mechanism, and the fact that the portions of the disc valve which are not hidden by the valve seating mechanism are those portions which border either the inlet fluid chamber or the outlet fluid chamber, where the mounting of a speed sensor would involve a fairly complex and expensive seal arrangement between the sensor and the endcap.

The invention has been described in great detail, sufficient to enable one skilled in the art to make and use the same. Various alterations and modifications of the invention will occur to those skilled in the art upon a reading and understanding of the foregoing specification, and it is intended to include all such alterations and modifications as part of the invention, insofar as they come within the scope of the appended claims.

I claim:

1. A rotary fluid pressure device of the type including housing means defining fluid inlet means and fluid outlet means; fluid energy translating displacement means associated with said housing means and including one member having rotational movement relative to said housing means, and one member having orbital movement relative to said housing means, to define expanding and contracting fluid volume chambers in response to said rotational and orbital movements; valve means cooperating with said housing means to provide fluid communication between said fluid inlet means and said expanding volume chambers, and between said contracting volume chambers and said fluid outlet means; input-output shaft means and means for transmitting torque between said member of said displacement means having rotational movement and said input-output shaft means; said valve means comprising a generally cylindrical spool valve member, defining a pair of end surfaces, and defining valving passages on its outer cylindrical surface, and being rotated at the speed of rotation of said member of said displacement means having rotational movement; said housing means comprising a valve housing section, defining a spool bore, and surrounding said spool valve member and defining a plurality of meter passages each being in fluid communication with one of said fluid volume chambers; characterized by:

(a) said valve housing section including a relatively thicker outer housing portion and a relatively thinner inner housing portion defining said spool bore; and (b) said inner housing portion being press-fit within said outer housing portion with an interference fit sufficient to preload said inner housing portion with a preload force at least equal to the equivalent force of a predetermined fluid pressure, whereby said inner housing portion will be able to withstand said predetermined fluid pressure, without substantial expansion of said spool bore.

2. A rotary fluid pressure device as claimed in claim 1 characterized by said outer housing portion defining a generally cylindrical inner surface and said inner housing portion defining a generally cylindrical outer surface press-fit into an interfering relationship with said inner surface over at lest a major portion of the surface thereof.

3. A rotary fluid pressure device as claimed in claim 2 characterized by said inner and outer surfaces cooperating to define said meter passages.

4. A rotary fluid pressure device as claimed in claim 1 characterized by said spool valve member and said valve housing section being disposed on the side of said displacement means opposite said input-output shaft means.

5. A rotary fluid pressure device as claimed in claim 4 characterized by said spool valve member being relatively solid, whereby said spool valve member is able to withstand the force of said predetermined fluid pressure, without substantial collapse of said spool valve member.

6. A rotary fluid pressure device of the type including housing means defining fluid inlet means and fluid outlet means; fluid energy translating displacement means associated with said housing means and including one member having rotational movement relative to said housing means, and one member having orbital movement relative to said housing means, to define expanding and contracting fluid volume chambers in response to said rotational and orbital movements; valve means cooperating with said housing means to provide fluid communication between said fluid inlet means and said expanding volume chambers, and between said contracting volume chambers and said fluid outlet means; input-output shaft means and means for transmitting torque between said member of said displacement means having rotational movement and said input-output shaft means; said valve means comprising a generally cylindrical spool valve member, defining a pair of end surfaces, and defining valving passages on its outer cylindrical surface, and being rotated at the speed or rotation of said member of said displacement means having rotational movement; said housing means comprising a valve housing section, defining a spool bore, and surrounding said spool valve member and defining a plurality of meter passages, each being in fluid communication with one of said fluid volume chambers; characterized by;

(a) said spool valve member and said valve housing section being disposed on the side of said displacement means opposite said input-output shaft means;

(b) said spool valve member being relatively solid, whereby said spool valve member is able to withstand the force of a predetermined fluid pressure, without substantial collapse of said spool valve member; and, (c) said fluid energy translating displacement means being disposed immediately adjacent said valve housing section, and comprising a gerotor gear set including an internally-toothed ring member and an externally-toothed star member disposed for orbital and rotational movement relative to said ring member.

7. A rotary fluid pressure device as claimed in claim 6 characterized by said spool valve member defining inlet valving passages and outlet valving passages on its outer cylindrical surface, said inlet and outlet valving passages being arranged in an alternating, interdigitated pattern about the outer cylindrical surface.

8. A rotary fluid pressure device as claimed in claim 7 characterized by said spool valve member defining a plurality N of each of said inlet valving passages and said outlet valving passages on its outer cylindrical surface, said valve housing section defining a plurality N+1 of said meter passages, said valving passages being in commutating fluid communication with said meter passages in response to rotation of said spool valve member.

9. A rotary fluid pressure device as claimed in claim 8 characterized by each of said valving passages extending to, and being open at, one of said end surfaces of said spool valve member, and said spool valve member further defining a plurality N of pressure-balancing passages, each of said pressure-balancing passages providing fluid communication from one of said inlet valving passages to a pressure-balancing recess defined by the other of said end surfaces.

10. A rotary fluid pressure device as claimed in claim 9 characterized by the transverse cross sectional area of each of said inlet valving passages is approximately equal to the area of its respective pressure-balancing recess, whereby said spool valve member is substantially axially balanced.

11. A rotary fluid pressure device of the type including housing means defining fluid inlet means and fluid outlet means; fluid energy translating displacement means associated with said housing means and including one member having rotational movement relative to said housing means, and one member having orbital movement relative to said housing means, to define expanding and contracting fluid volume chambers in response to said rotational and orbital movements; valve means cooperating with said housing means to provide fluid communication between said fluid inlet means and said expanding volume chambers, and between said contracting volume chambers and said fluid outlet means; input-output shaft means and means for transmitting torque between said member of said displacement means having rotational movement and said input-output shaft means; said housing means comprising a valve housing section defining a plurality of meter passages, each being in fluid communication with one of said fluid volume chambers; said valve means comprising a rotatable valve member, being rotated at the speed of rotation of said member of said displacement means having rotational movement; said valve member and said valve housing section being disposed on the side of said displacement means opposite said input-output shaft means; characterized by:

(a) said valve member comprising a generally cylindrical spool valve member defining a pair of end surfaces and defining valving passages on its outer cylindrical surface;

(b) said spool valve member being relatively solid, whereby said spool valve member is able to withstand the force of a predetermined fluid pressure, without substantial collapse of said spool valve member; and, (c) said fluid energy translating displacement means being disposed immediately adjacent said valve housing section, and comprising a gerotor gear set including an internally-toothed ring member and an externally-toothed star member disposed for orbital and rotational movement relative to said ring member.

12. A rotary fluid pressure device as claimed in claim 11 characterized by said star member and said spool valve member defining first and second pluralities of openings, said device further characterized by a plurality of elongated pin members operably engaging said openings to transmit said rotational movement of said star member to said spool valve member.

13. A rotary fluid pressure device as claimed in claim 12 characterized by said ring member and said star member defining an eccentricity; one of said first and second pluralities of openings being diametrally oversized, relative to said pin members by an amount equal to approximately twice said eccentricity.

14. A rotary fluid pressure device as claimed in claim 11 characterized by means operable to transmit said orbital and rotational movement of said externally-toothed star member into said rotational movement of said rotatable valve member.

15. A rotary fluid pressure device as claimed in claim 11 characterized by said housing means including a valve housing section comprising a relatively thicker outer housing portion and a relatively thinner inner housing portion, defining a spool bore; said inner housing portion being press-fit within said outer housing portion with an interference fit sufficient to preload said inner housing portion with a preload force at least equal to the equivalent force of said predetermined pressure, without substantial expansion of said spool bore.

* * * * *